United States Patent [19]

Goshima et al.

[11] 4,147,501

[45] Apr. 3, 1979

[54] FIXING DEVICE

[75] Inventors: Yoshitomo Goshima, Yokohama; Shigeyoshi Onoda, Kawasaki; Kazuo Kawakubo, Hino; Osamu Hoshino, Tokyo; Haruo Tsunoi, Kawasaki; Noriyoshi Iida, Ichikawa, all of Japan

[73] Assignee: Canon Kabushiki Kaisha, Tokyo, Japan

[21] Appl. No.: 883,708

[22] Filed: Mar. 6, 1978

Related U.S. Application Data

[63] Continuation of Ser. No. 742,355, Nov. 16, 1976, abandoned.

[30] Foreign Application Priority Data

Nov. 22, 1975 [JP] Japan ..... 50/140956

[51] Int. Cl.[2] ..... H05B 3/10; G03G 15/20

[52] U.S. Cl. ..... 432/60; 355/3 FU; 219/469; 74/798

[58] Field of Search ..... 432/59, 60, 228, 230; 355/3 FU; 219/216, 469; 100/93 RP; 74/798

[56] References Cited

U.S. PATENT DOCUMENTS

| | | | |
|---|---|---|---|
| 3,452,181 | 6/1969 | Stryjewski | 432/60 |
| 3,754,819 | 8/1973 | Braun | 432/60 |
| 3,861,863 | 1/1975 | Kudsi | 432/60 |
| 3,998,584 | 12/1976 | Wada et al. | 432/228 |

*Primary Examiner*—Henry C. Yuen

*Attorney, Agent, or Firm*—Fitzpatrick, Cella, Harper & Scinto

[57] ABSTRACT

A fixing device comprises a pair of rollers for heating and pressing a copy medium carrying a toner image thereon, a control gear, a planet gear meshing with the control gear and revolvable about the control gear, means for revolving the planet gear, and means responsive to the revolutional movement of the planet gear to displace the pair of rollers between a first position in which they are in pressure contact with each other and a second position in which they are not in pressure contact with each other.

20 Claims, 7 Drawing Figures

FIXING DEVICE

This is a continuation of application Ser. No. 742,355 Nov. 16, 1976, now abandoned.

BACKGROUND OF THE INVENTION a. Field of the Invention

This invention relates to a fixing device which uses a pair of fixing rollers for heating and fixing a thermally fusible, visualized image on a copy medium.

b. Description of the Prior Art

The conventional fixing device using a pair of fixing rollers of the described type has a heating roller for fixing a toner image on a copy medium and a press roller for urging the copy medium against the heating roller, and as a construction thereof, there is known a two-roller construction comprising a heating roller and a press roller or a three-roller construction comprising a heating roller, a press roller and a heating roller.

Usually, these heating and press rollers comprise a rigid and an elastic roller, respectively, and are urged into contact with each other so that the time for fixation of the copy medium may be afforded by an increase in the area of contact between the rollers resulting from the deformation of the elastic roller.

Various methods of imparting a pressure to the elastic material are known (for example, those using a cam, a link or air pressure), but no particular attention has been paid to the method of releasing the pressure. Even when the power supply to the device happens to be cut off for example, when the electric current to the device it cut off due to service interruption or other accident during copying operation, the elastic roller would suffer from a permanent distortion because of the pressure and residual heat unless it is released from its pressed state, thus resulting in seriously hampered durability of the device.

Therefore, the pressure release is indispensable when the device has been stopped and this has given rise to the need for a fixing device which has covered such a problem.

SUMMARY OF THE INVENTION

It is therefore an object of the present invention to provide a fixing device in which a pair of fixing rollers may be reliably brought into and out of pressure contact with each other.

It is a further object of the present invention to provide a pair of fixing rollers which may be automatically released from their pressure contact position whenever the power supply is cut off due to service interruption or other accident during their pressure contact, whereby the pair of fixing rollers may be protected against deformation.

It is still a further object of the present invention to provide a fixing device in which the pair of fixing rollers, when relesed from their pressure contact position, may rotate while keeping soft contact therebetween, whereby the pair of fixing rollers may be heated and maintained at a desired temperature during the waiting time for fixation.

The invention will become more fully apparent from the following detailed description thereof taken in conjunction with the accompanying drawings.

DESCRIPTION OF THE PREFERRED EMBODIMENTS

Figure 1:
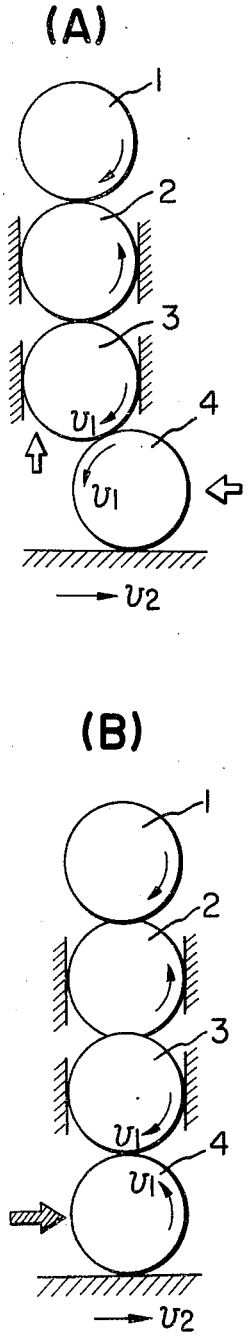
FIGS. 1(A) and 1(B) are views illustrating the principle of the present invention.

FIGS. 1(A) and 1(B) which illustrates the principle of the present invention, there are seen heating rigid rollers 1 and 3, a fixing elastic roller 2 and a pressing rigid roller 4. The pressing roller 4 is disposed between and in contact with the heating roller 3 and a horinzontal surface. It is to be understood that the heating roller 3 and the horizontal surface are moved at a peripheral velocity $v_1$ and a velocity $v_2$ respectively, in the directions of respective arrows in FIGS. 1(A) and 1(B), and the pressing roller 4 is rotated in synchronism with the peripheral velocity $v_1$ of the heating roller 3.

In order that a shift may occur from the soft contact position of the hollers 1, 2 and 3 as shown in FIG. 1(A), to the pressure contact position of FIG. 1(B), the velocities may be selected as $v_1 > v_2$ and the directions of rotation may be chosen appropriately, whereby the difference in peripheral velocity between the rollers may cause the pressing roller 4 to be displaced in the leftward direction to push through and raise the roller 3 from therebelow, until the pressing roller comes to the position of FIG. 1(B). If $v_1 = v_2$ when the action of pressure contact is completed, the relations in force between the various rollers become balanced in the position of FIG. 1(B), thus permitting fixation to be accomplished.

Release of the pressure contact may be accomplished by making $v_2$ greater than $v_1$, which would have the same effect as imparting a force to the roller 4 in the direction of arrow A while maintaining the relation that $v_1 = v_2$, whereby the roller 4 is brought out of its pressing position to release the pressure contact force.

The above-described method utilizes the relations in rotational force between the rollers to make and release the pressure contact and this is very effective to simplify the device.

However, if a parting agent such as silicone oil or the like is applied to the fixing roller to enhance the parting characteristic thereof, a thin film of lubricant may be formed on the surface of the roller to cause the risk of the roller slipping, which would sometimes lead to lack of the reliability with which the roller pushes through.

The present invention employs a planet gear, instead of the pressing roller 4, to ensure the reliability of operation and thereby eliminate the above-noted disadvantages.

FIGS. 2 to 7 show an embodiment of the fixing device in an electrophotographic copying apparatus to which the present invention is applied.

Figure 2:
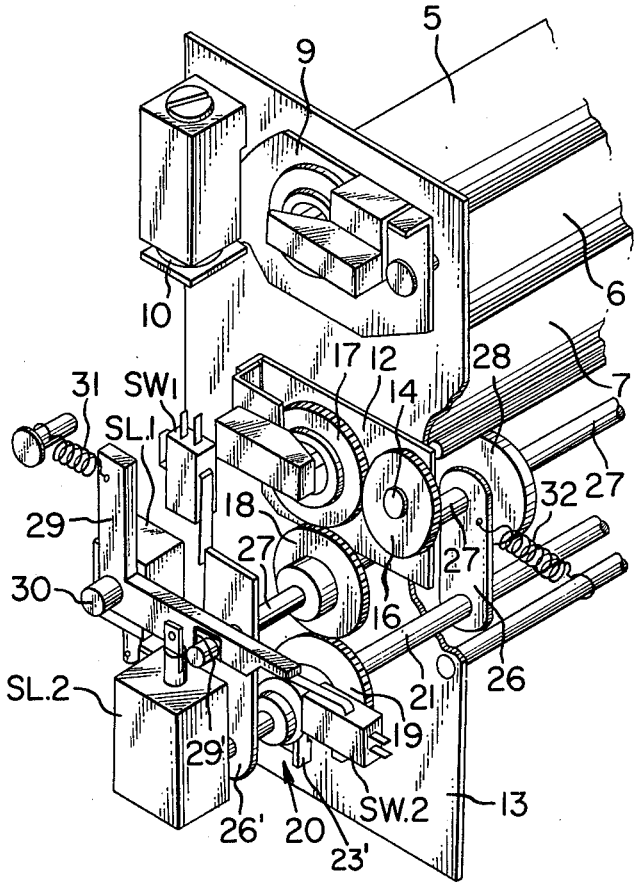
FIG. 2 is a schematic perspective view showing essential portions of the fixing device according to an embodiment of the present invention.

In FIG. 2, a heating roller 5 formed by a pipe of a material having a good heat conductivity such as copper, aluminum or the like has a heater 8 therewithin (FIG. 3), and is mounted at each end thereof to a support plate 9 by means of bearings. The support plate 9 is mounted to a base plate 13 of the device by means of a pivot shaft, and is urged downwardly with the heating roller 5 by a compression spring 10. A fixing roller 6 if formed of a heat-resistant material having a good parting characteristic, for example, silicon rubber, and as required, may have applied to the surface thereof an anti-offset liquid such as silicone oil or the like to expedite the parting characteristic of the roller. The peripheral surface of the fixing roller 6 is heated to and maintained at a sufficient temperature to heat and fuse the toner image by the heat from the heating roller, and has each end thereof mounted for vertical movement on the base plate 13 by means of bearings.

Figure 3:
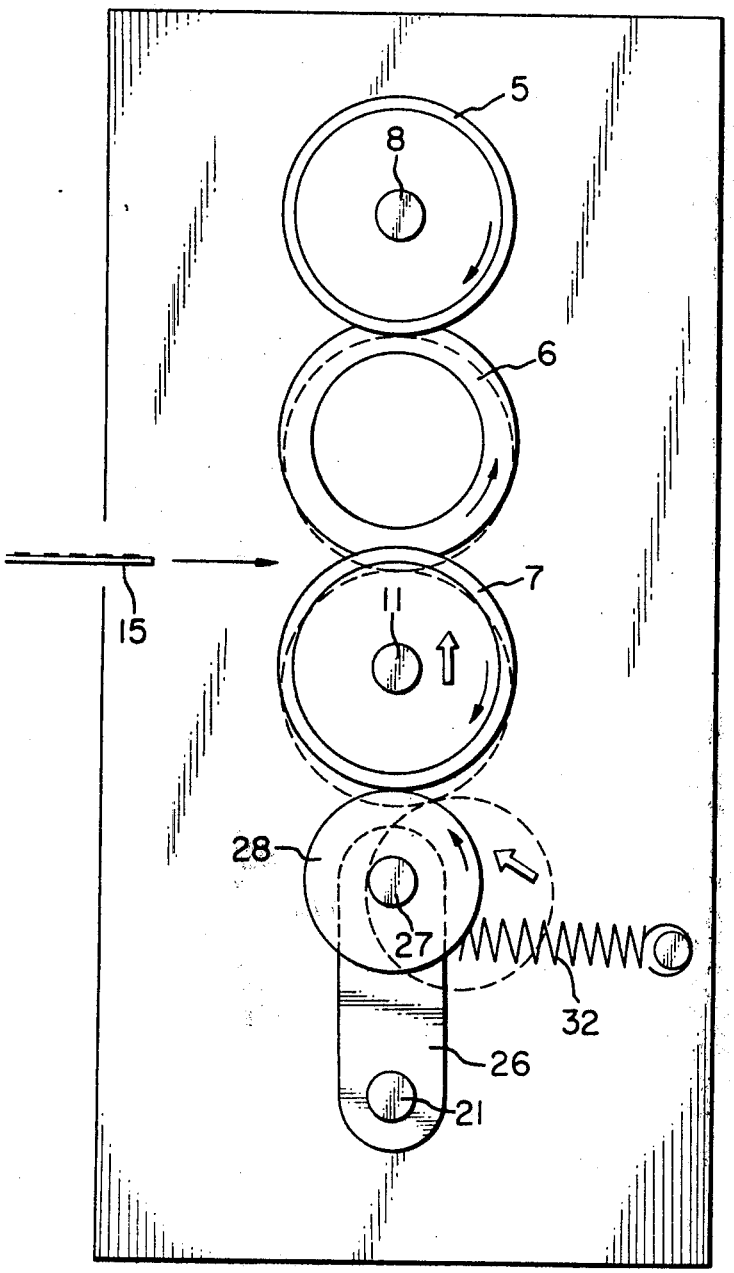
FIG. 3 is a cross-sectional side view of the device.

A pressure contact roller 7 is formed by a pipe of a material having a good heat conductivity such as copper, aluminum or the like and having the peripheral surface coated with a material having a good parting characteristic, for example, Teflon (tetrafluoroethylene resin), and has a heater 11 therewithin (FIG. 3). The pressure contact roller 7 has each end thereof mounted to a rocking plate 12 by means of bearings. The rocking plate 12 is mounted on the base plate 13 for rocking movement about a shaft 14 secured to the base plate 13.

A driving gear 16 connected to a drive source (not shown) is rotatably mounted on the shaft 14 and in meshing engagement with a pressure contact roller gear 17. The pressure contact roller gear 17 is connected to the pressure contact roller 7 and rotation of the pressure contact roller gear 17 causes rotation of the pressure contact roller 7.

A copy medium (transfer medium) 15 carrying thereon an unfixed toner image is transported into the nip between the fixing roller 6 and the pressure contact roller 7 with the image-bearing surface thereof facing the fixing roller, and fixation of the toner image takes place with the copy medium being pressed and heated as it passes between the two rollers 6 and 7.

When the drive from the drive source is transmitted to the driving gear 16, the pressure contact roller 7 is rotated by means of the pressure contact roller gear 17. When no fixation is being effected, the rollers 5, 6 and 7 are rotated while keeping soft contact (non-pressure contact) with one another so that the fixing roller 6 is maintained in heated condition by the heating roller 5 and the pressure contact roller 7.

The pressure contact roller gear 17 is in meshing engagement with a planet gear 8 rotatably mounted on a rocking shaft 27. The planet gear 18 is in meshing engagement with a control gear 19 rotatably mounted on a stationary shaft 21 secured to the base plate 13.

Figure 4:
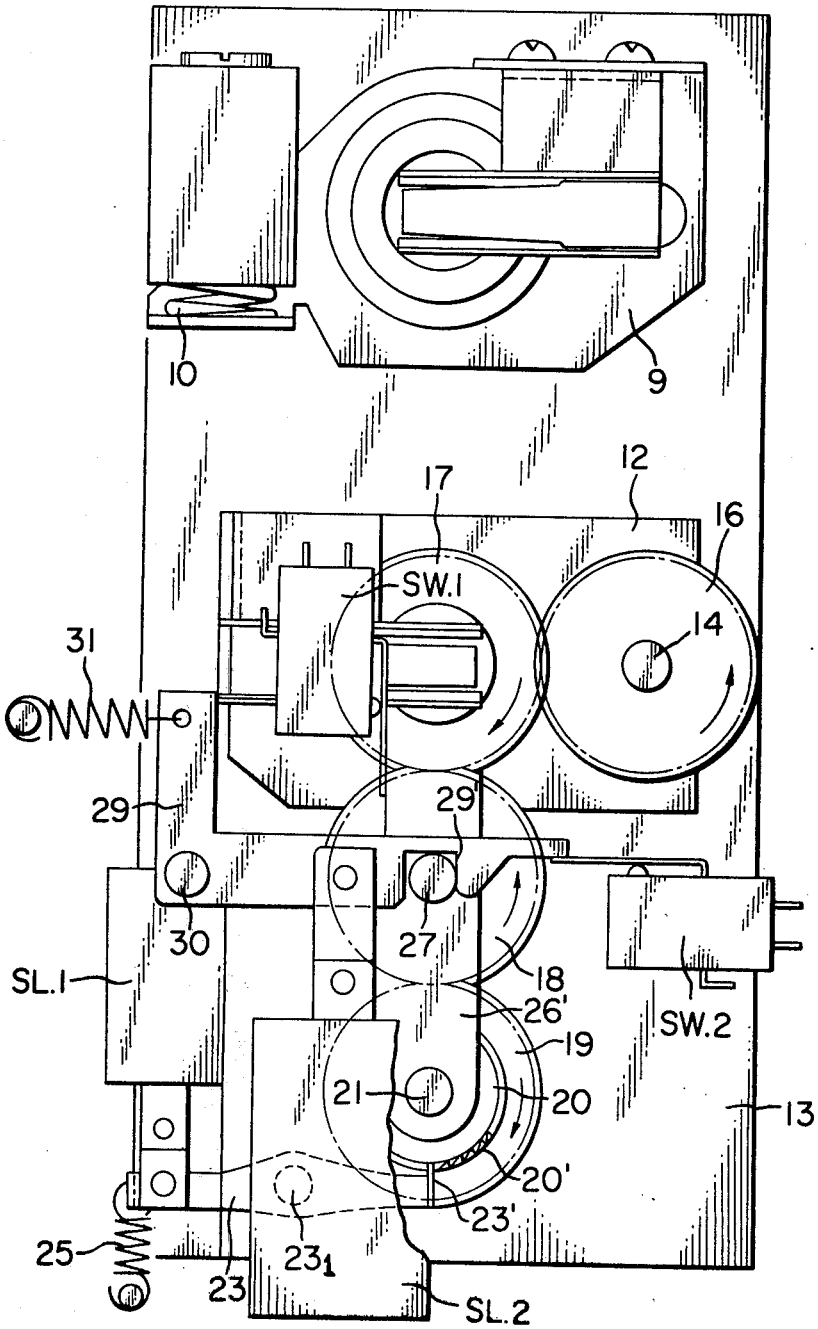
FIG. 4 is a side view of the device.
Figure 6:
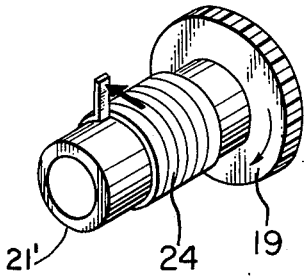
FIG. 6 is a perspective view showing a portion of the clutch mechanism in the device.
Figure 7:
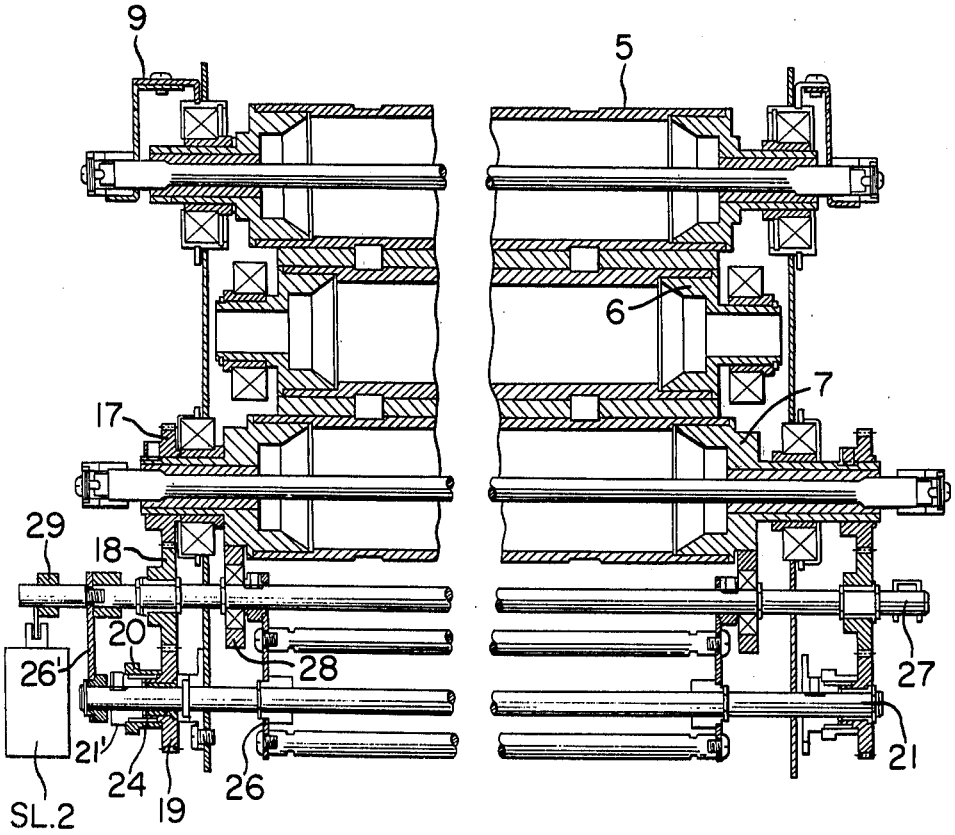
FIG. 7 is a front cross-sectional view of the device.

The control gear 19 is operatively connected to a fixed shaft 21 through a spring clutch 20. The spring clutch 20 has a coil spring 24 wound on the gear 19 and a sleeve 21' keyed to the fixed shaft 21, as shown in FIGS. 6 and 7 ratchet 20' is provided over the coil spring 24, as shown in FIGS. 4 and 7. This spring clutch 20 is controlled by an electromagnetic plunger SL1 through a lever 23.

As shown in FIG. 4, the lever 23 is rotatably supported on a shaft 23' and biased for counter-clockwise rotation by a tension spring 25.

When the electromagnetic plunger SL1 is electrically unenergized, the lever 23 is rotated counter-clockwise about a shaft $23_1$ by the action of the tension spring 25 so that a pawl 23' at the end of the lever 23 meshes with the ratchet 20' of the spring clutch 20. By this, as shown in FIG. 6, the coil spring clutch 20 is caused to expand, whereby the connection between the control gear 19 and the fixed shaft 21 is broken, thus rendering the control gear 19 free to rotate with respect to the fixed shaft 21. When the electromagnetic plunger SL1 is electrically energized, the lever 23 is rotated clockwise about the shaft $23_1$ to disengage the pawl 23' of the lever 23 from the ratchet 20' of the spring clutch 20. By this, the coil spring 24 of the spring clutch 20 is contracted to couple the control gear 19 to the fixed shaft 21, so that rotation of the control gear 19 is forcibly blocked.

The spring clutch may be replaced by any other known mechanical or electrical clutch.

Rotatably mounted on the fixed shaft 21 are a first 26 and a second lever 26' (FIG. 2), the other ends of which have a rocking shaft 27 mounted thereon.

The first lever 26 is biased for clockwise rotation about the fixed shaft 21 by the action of a tension spring 32. A stop (not shown) engageable with the second lever 26' is provided at a suitable location so as to ensure meshing engagement between the gears 16, 17, 18 and 19 even if the rocking shaft 27 is displaced to the position of FIG. 5.

A roller 28 is rotatably mounted on the rocking shaft 27 and in contact relationship with the pressure contact roller 7, and the pressure contact roller 7 is vertically displaceable by displacement of the rocking shaft 27.

A lock arm 29 having a cut-away portion 29' for restricting the movement of the rocking shaft 27 is rotatably mounted on a shaft 30, and biased for counter-clockwise rotation about the shaft 30 by a tension spring 31.

The lock arm 29 is coupled to the electromagnetic plunger SL2.

Operation of the device will now be described.

Figure 5:
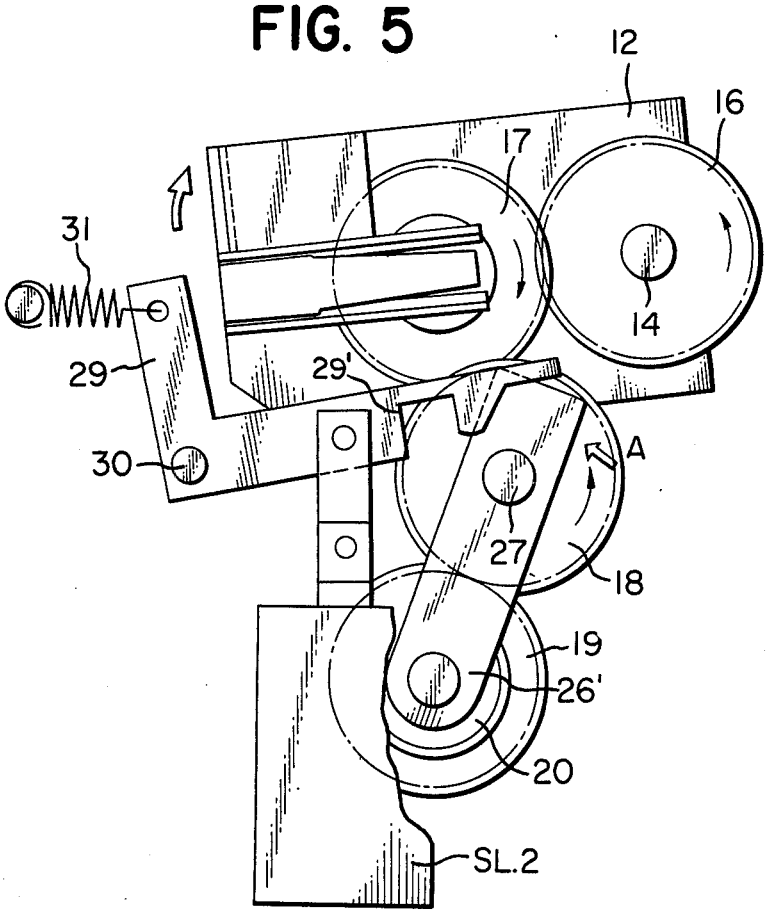
FIG. 5 is a side view showing the non-pressure contact position of the device.

When no fixation is being effected, the various elements of the device are in their positions shown in FIG. 5, where the gears 16, 17, 18 and 19 are rotating in meshing engagement with one another, whereby the rollers 5, 6, 7 are rotated in soft contact with one another, namely, in a non-pressure contact relationship. Thus, the fixing roller 6 is uniformly heated and maintained at a desired temperature by the rollers 5 and 7.

When a signal for imparting a pressure in a predetermined sequence of the copying apparatus is sent to the present device, the electromagnetic plunger SL1 is electrically energized by this signal so that the lever 23 is rotated clockwise about the shaft 23' (FIG. 3), whereby the pawl 23' of the lever 23 is disengaged from the ratchet 20' of the spring clutch 20 and the control gear 19 is coupled to the fixed shaft 21, so that the control gear 19 is forcibly blocked against rotation.

By the stoppage of the control gear 19, the rotating planet gear 18 rolls over the control gear 19 while revolving counter-clockwise about the fixed shaft 21.

By the revolutional movement of the planet gear 18, the roller 28 mounted on the shaft 27 in common with the planet gear 18 is rotated counter-clockwise about the fixed shaft 21 to raise the pressure contact roller 6 from therebelow. By the pressure roller 6 being so raised, the fixing roller 6 is also displaced upwardly. The fixing roller 6 and the pressure contact roller 7 so raised are brought into pressure contact with each other because the heating roller 5 is biased from above to below by the compression spring 10. It will be noted that if the spring constant of the compression spring 10 is suitably selected, each roller may be maintained in a balanced condition by a desired pressure force.

As the second lever 26' is rotated counter-clockwise by the revolutional movement of the planet gear 18, the end of the second lever 26' engages and closes the microswitch SW1 and the electromagnetic plunger SL2 is energized by the electrical signal from this microswitch SW1. Upon energization of the electromagnetic plunger SL2, the lock arm 29 is rotated clockwise about the shaft 30 so that the cut-away portion 29' of the lock arm is fitted to the rocking shaft 27 to block the movement of the rocking shaft 27. When this occurs, the end of the lock arm 29 engages and closes the microswitch SW2 and the electromagnetic plunger SL1 is electrically deenergized by the electrical signal from the microswitch SW2. As a result, the lever 23 is rotated counterclockwise to bring its pawl 23' into meshing engagement with the ratchet 20', thus releasing the control gear 19 from its fixed state into a freely rotatable state.

Thus, the pressure imparting action is completed and fixation of copy medium may take place under such pressure contact condition.

When the work of fixation is completed, a signal for releasing the pressure in a predetermined sequence of the copying apparatus is sent to the present device. By this signal, the electromagnetic plunger SL2 is first deenergized. Thus, the lock arm 29 is rotated counterclockwise by the tension spring 31 to disengage the cut-away portion 29' from the rocking shaft 27, which is thus pulled back by the tension spring 32, whereby the first 26 and the second lever 26' are rotated clockwise about the fixed shaft 21. By the displacement of the rocking shaft 27, the planet gear 18 is revolved clockwise about the fixed shaft 21 and the roller 28 is also moved to displace the pressure contact roller 7 downwardly. As a result, the rollers 5, 6 and 7 which have so far been in pressure contact with one another are returned from the pressure contact position to the non-pressure contact position, as indicated by the broken lines in FIG. 3.

In the present embodiment, which is constructed as described above, whenever power supply is stopped during pressing due to service interruption or as by the main switch being opened accidentally, the electromagnetic plunger SL2 is deenergized and the lock arm 29 is disengaged from the rocking shaft 27 by the spring 31 to immediately release the pressure and prevent deformation of the fixing rubber roller 6, thus enabling the safety of the device to be maintained.

Also, since the period of deformation of the elastic rubber roller should preferably be as short as possible, the time of pressure contact and the time of pressure contact release may be set such that pressure is imparted when a copy medium has come close to the fixing device and that the pressure is released when the copy medium has left the fixing device, whereby the fixing roller may be maintained in heated condition during the waiting period for fixation.

In an alternative embodiment of the present invention, the drive for the control gear 19 may be provided from other drive source and a difference in relative velocity may be provided between the pressure contact roller gear 17 and the control gear 19, whereby the planet gear 18 may be revolved to impart or release the pressure.

While the present embodiment has been shown as using three rollers, the invention may also be carried out by using two rollers.

Further, silicone oil or the like applied to the elastic rollers to enhance their parting characteristic may sometimes cause slip and accordingly, non-rotation, of the rollers 5 and 6. To avoid this, drive may be imparted even to the roller 5 or 6 and this forms no hindrance in carrying out the invention.

What we claim is:

1. A fixing device wherein a sheet carrying a toner image is passed between the nip of a pair of rollers, at least one of which is heated, thereby fixing the toner image on the member, the improvement comprising:

means mounting the rollers for relative radial movement between a pressure-contact relationship and a non-pressure-contact relationship;

a first gear mounted for rotational movement;

a second gear meshing with said first gear and revolvable about said first gear, so that the center of said second gear moves around said first gear;

means providing relative revolving movement between said first and second gears, in response to said rotation of said second gear, for revolving said second gear around said first gear from a first to a second position; and pressure applying means coupled to said second gear and operatively associated with at least one of said rollers for moving said rollers into said pressure-contact relationship in response to revolving movement of said second gear to said first position, and into said non-pressure-contact relationship in response to revolving movement of said second gear to said second position.

2. A fixing device as set forth in claim 1, wherein said means for revolving said second gear includes means for producing different peripheral speeds of said first and second gears.

3. A fixing device as set forth in claim 2, wherein said different speed producing means includes means for controlling the rotation of said first rotatable gear.

4. A fixing device as set forth in claim 3, wherein said control means includes means for stopping the rotation of said first rotatable gear.

5. A fixing device as set forth in claim 2, wherein said different speed producing means includes clutch means for connecting said first rotatable gear to a fixed member.

6. A fixing device as set forth in claim 5, further comprising means for detecting the pressure-contact relationship of said rollers; and means coupled to said detecting means, for stopping the revolving movement of said second rotatable gear when said pair of rollers are in said pressure-contact relationship, wherein, when said stopping means stops said second gear, said clutch means releases said first gear from said fixed member to allow free rotation thereof.

7. A fixing device as set forth in claim 1, wherein said means for rotating said second gear comprises a third gear coupled to one of said rollers and meshing with said second gear, and means for driving said third gear.

8. A fixing device as set forth in claim 1, wherein said pressure applying means includes a rotatable member in contact with one of said rollers and being movable in response to revolving movement of said second gear.

9. A fixing device as set forth in claim 1, further comprising means for stopping revolving movement of said second gear and for releasably holding said second gear in said first position.

10. A fixing device as set forth in claim 9, wherein said stopping means includes means for detecting a position of said second gear and means connected to said detecting means for locking said second gear at said first position so as to stop said second gear from further revolving movement.

11. A fixing device as set forth in claim 10, wherein said locking means is actuated by solenoid means.

12. A fixing device as set forth in claim 11, wherein said means for revolving said second gear includes means for urging said second gear toward said second position when said locking means is deactuated.

13. A fixing device as set forth in claim 1, wherein said means for revolving said second gear includes means for stopping rotation of said first gear, so as to revolve said rotating second gear around said stopped first gear toward said first position, and spring means for urging said second rotatable gear to revolve toward said second position.

14. A fixing device as set forth in claim 13, further comprising means for locking said second gear in said first position to hold it against revolving movement, thereby maintaining said pair of rollers in said pressure-contact relationship, and solenoid means for being energized to actuate said locking means, wherein said spring means is operative to revolve said second rotatable gear toward said second position when said solenoid is not deenergized.

15. A fixing device as set forth in claim 13, further comprising means for heating an outer surface of one of said rollers.

16. A fixing device wherein a sheet carrying a toner image is passed between the nip of a pair of rollers, at least one of which is heated, thereby fixing the toner image on the member, the improvement comprising:

means mounting the rollers for relative radial movement between a pressure-contact relationship and a nonpressure-contact relationship;

a first gear mounted for rotational movement;

a second gear meshing with said first gear and revolvable about said first gear so that the center of said second gear moves around said first gear;

means providing a first relative rotational movement between said first and second gears for revolving said second gear around said first gear toward a first position;

means providing a second relative rotational movement between said first and second gears for revolving said second gear around said first gear, in an opposite direction, toward a second position; and means coupled to said second gear and operatively associated with at least one of said rollers for controlling said relative movement between said rollers in response to revolving movement of said second gear so that said rollers are placed into said pressure-contact relationship in response to revolving movement of said second gear to said first position, and so that said pair of rollers move into said non-pressure-contact relationship in response to revolving movement of said second gear to said second position.

17. A fixing device for an electrogaphic machine comprising:

a pair of abutting rollers adapted to pass therethrough a sheet carrying a toner image;

means for heating at least one of said rollers;

a first gear mounted for rotation at a predetermined position;

a second gear meshing with said first rotatable gear;

means providing relative revolving movement between said first and second gears for revolving said second gear around said first gear, said revolving means including means for rotating said second gear, and means for stopping rotation of said first gear to control the revolution of said second gear thereabout;

supporting means for rotatably supporting said second gear, wherein said supporting means is mounted for revolving movement with said second gear in response to rotational movement of said second gear; and means connected to said supporting means and operatively associated with at least one of said rollers for producing relative radial movement between said rollers in response to said revolving-movement of said supporting means, so that said rollers are selectively placed into a pressure-contact relationship or a non-pressure-contact relationship.

18. A fixing device for an electrographic machine comprising:

a pair of abutting rollers adapted to pass therethrough a sheet carrying a toner image;

means for heating at least one of said rollers;

a planetary gear, and two rotatable gears, said planetary gear being engaged with said two rotatable gears and revolvable around one of said rotatable gears;

means for rotatably driving one of said two rotatable gears;

means for revolving said planetary gear in response to said rotation of one of said gears; and means coupled to said planetary gear and operatively associated with at least one of said rollers for producing relative radial movement between said rollers in response to revolving movement of said planetary gear, wherein said rollers are selectively placed into a pressure-contact relationship or a non-pressure-contact relationship with each other.

19. A fusing device, for use with an electrographic machine to fix a heat-fusible image on a sheet member comprising:

a pair of rollers adapted to pass the sheet member therethrough, at least one of said rollers having a resilient surface;

a first member mounted for rotational movement;

a second rotatable member engaged with said first member for revolving movement thereabout;

means for rotatably supporting said second member, wherein said supporting means revolves with said second member;

means for causing said rovolving movement of said second member and said supporting means, said revolving means including means for rotating said second member and means for controlling the rotation of said first member; and means connected to said supporting means and operatively associated with at least one of said rollers for producing relative radial movement between said rollers in response to said revolving movement of said supporting means, so that said rollers are placed into a first position wherein they are in a pressure-contact relationship with each other to apply pressure to the sheet member so as to fix the heat-fusible image, and a second position wherein they are in a non-pressure-contact relationship, thereby preventing deformation of said resilient surface.

20. A fusing device as set forth in claim 19, wherein said first and second rotatable members are first and second gears, respectively, engaging with each other.

* * * * *

UNITED STATES PATENT OFFICE

CERTIFICATE OF CORRECTION

Patent No. 4,147,501 Dated April 3, 1979

Inventor(s) Yoshitomo Goshima, et al

It is certified that error appears in the above-identified patent and that said Letters Patent are hereby corrected as shown below:

Column 2, Line 26; change "hollers" to --rollers--;

Column 3, Line 45; change "8" to --18--;

Column 3, Line 53; after "7" insert --, and a--.

Signed and Sealed this

*Eighteenth* Day of *September 1979*

[SEAL]

*Attest:*

*Attesting Officer*

LUTRELLE F. PARKER

*Acting Commissioner of Patents and Trademarks*